US007870759B2

(12) United States Patent
Peyron

(10) Patent No.: US 7,870,759 B2
(45) Date of Patent: Jan. 18, 2011

(54) PROCESS AND ARRANGEMENT FOR THE BACKUP SUPPLY OF A PRESSURIZED GAS THROUGH CRYOGENIC LIQUID VAPORIZATION

(75) Inventor: Jean-Marc Peyron, Creteil (FR)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 203 days.

(21) Appl. No.: 10/558,584

(22) PCT Filed: May 14, 2004

(86) PCT No.: PCT/FR2004/001184

§ 371 (c)(1),
(2), (4) Date: Nov. 28, 2005

(87) PCT Pub. No.: WO2004/109207

PCT Pub. Date: Dec. 16, 2004

(65) Prior Publication Data

US 2007/0044506 A1 Mar. 1, 2007

(30) Foreign Application Priority Data

May 28, 2003 (FR) ..... 03 06511

(51) Int. Cl.
*F25J 3/00* (2006.01)

(52) U.S. Cl. ..... 62/643; 62/646; 62/654; 62/656; 62/50.2

(58) Field of Classification Search ..... 62/643, 62/646, 654, 656, 50.2
See application file for complete search history.

(56) References Cited

U.S. PATENT DOCUMENTS 4,961,325 A * 10/1990 Halvorson et al. ..... 62/48.1

(Continued)

FOREIGN PATENT DOCUMENTS

EP 0 452 177 10/1991

(Continued)

OTHER PUBLICATIONS

International Search Report for PCT/FR2004/001184.

(Continued)

*Primary Examiner*—Frantz F Jules
*Assistant Examiner*—Azim Rahim
(74) *Attorney, Agent, or Firm*—Elwood L. Haynes

(57) ABSTRACT

In a process for supplying a pressurized gas, a pressurized gas at a high production pressure is produced as an end product by separating a gaseous mixture in a separator apparatus (3, 5), a liquid to be pressurized is stored in a store (9), storing liquid is tapped, and it is pressurized with a pump (11) and at least part of the pressurized liquid is sprayed in a sprayer (27) to produce the pressurized backup gas (29) having substantially the same pressure or a pressure higher than the pressurized gas to be produced, liquid is circulated in a substantially vertical duct (13), optionally within the cold box (33) of the separator apparatus, and at least part of the duct length is at a level above the sprayer and before and/or after starting up the pump (11), liquid is sent from the duct to the sprayer where the liquid is sprayed to provide pressurized backup gas having substantially the same purity or a purity higher than the pressurized gas to be produced (31).

11 Claims, 6 Drawing Sheets

U.S. PATENT DOCUMENTS

Figure 1:
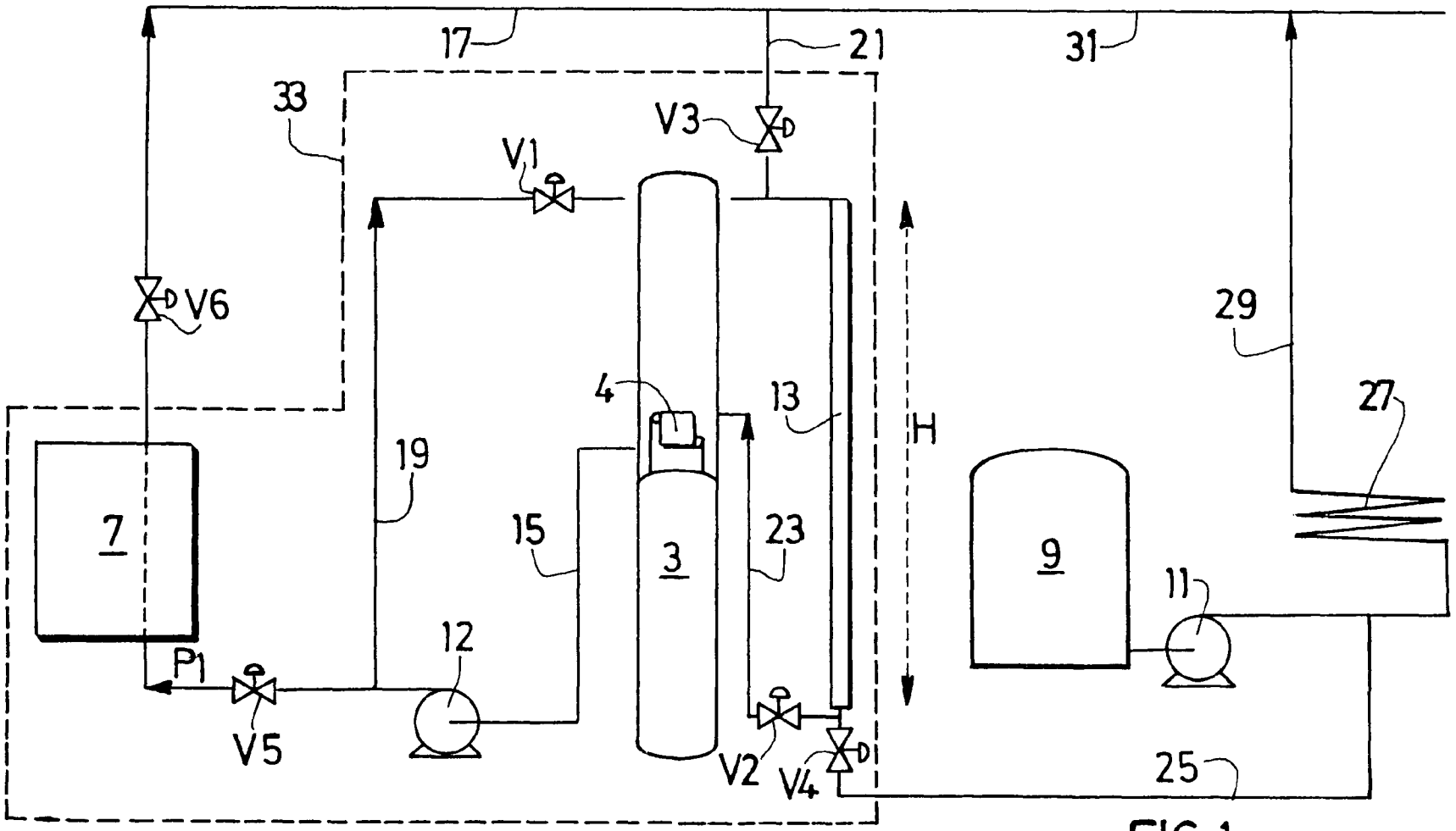

| | | | | |
|---|---|---|---|---|
| 5,157,927 | A | 10/1992 | Darchis et al. | |
| 5,566,556 | A | 10/1996 | Ekins et al. | |
| 5,983,666 | A * | 11/1999 | Straub et al. | 62/643 |
| 6,038,885 | A | 3/2000 | Corduan et al. | |
| 6,155,078 | A * | 12/2000 | Miyashita et al. | 62/643 |
| 6,345,517 | B1 * | 2/2002 | Jahnke | 62/643 |

FOREIGN PATENT DOCUMENTS

| | | |
|---|---|---|
| EP | 0 538 857 | 4/1993 |
| EP | 0 628 778 | 12/1994 |
| EP | 0 681 153 | 11/1995 |
| EP | 0 756 144 | 1/1997 |

OTHER PUBLICATIONS

Scharle W. J.: "*Large Oxygen Plant Economics and Reliability*", Bulletin Y-143, National Fertilizer Division Center, Tennessee Valley Authority, Muscle Shoals, Alabama.

Scharle W. J., et al.: "*Oxygen Facilities for Synthetic Fuel Projects*", Journal of Engineering for Industry, Nov. 1981, vol. 103, pp: 409-417.

"*Publication*", Research Disclosure, Kenneth Mason Publications, Hampshire, Great Britain, Jun. 2001, pp. 988-991.

* cited by examiner

PROCESS AND ARRANGEMENT FOR THE BACKUP SUPPLY OF A PRESSURIZED GAS THROUGH CRYOGENIC LIQUID VAPORIZATION

This invention relates to methods and installations for the backup supply of a pressurized gas by vaporization of cryogenic liquids, in particular those used for supplying customers with gaseous products (nitrogen, oxygen, argon) when the industrial installations (such as air separation units) can ensure only partial supply of the product, or even no supply at all (for example in the event of trip-out, load reduction for an electricity tariff constraint, etc.). The invention also applies to the storage of other cryogenic liquids, such as hydrogen, helium and carbon monoxide.

Partial oxidation reactors require a supply of high-pressure (25 bar and higher) oxygen with a pressure stabilized to ±1% of the nominal value. Air separation units supplying oxygen must therefore comply with this constraint, irrespective of their operating mode and in particular in the event of the air separation unit shutting down. In this case, a system comprising a liquid oxygen storage tank, cryogenic pumps and a steam-heated vaporizer ensure the delivery stream.

An backup vaporizer is illustrated in EP-A-0 452 177 in which liquid nitrogen coming from a storage tank is vaporized in an auxiliary vaporizer by heat exchange with the ambient air.

EP-A-0 628 778 discloses a cryogenic liquid storage tank in which the liquid is pumped and then vaporized in a vaporizer before being sent to the customer.

EP-A-0 756 144 discloses a cryogenic liquid storage tank, the liquid of which is pumped and then vaporized in a vaporizer before being sent to the customer.

"*Large Oxygen Plant Economics and Reliability*" by W. J. Scharle, Bulletin Y-143, National Fertilizer Division Center, Tennessee Valley Authority, Muscle Shoals, Ala. and "*Oxygen Facilities for Synthetic Fuel Projects*" by W. J. Scharle and K. Wilson, Journal of Engineering for Industry, November 1981, Vol. 103, pp. 409-417 describe a backup oxygen production system composed of:

- a storage tank containing a quantity of product in liquid form;
- several pumps (here, two pumps for reliability reasons) that withdraw the liquid contained in the storage tank in order to compress it to the pressure normally delivered to customers (pressure in the line); and
- an exchanger, the function of which is to vaporize the pressurized liquid.

On leaving this equipment, the gas is in general close to the ambient temperature and is sent to the customer. Depending on the energy sources available on the site and their costs, this exchanger may use for example air, steam, or natural gas to vaporize the pressurized liquid.

One of the main features of these backup installations is their start-up time. This is particularly important as it determines the quality and the continuity of the gas supply to customers. An excessively long start-up time after tripping of the production unit may cause too great a pressure drop in the line and may generate malfunctions in customer processes.

In the case of the oxygen production systems described in the above articles, a gaseous oxygen buffer tank is provided in order to supply the pressurized product during the time needed to bring the pump into operation (about 15 to 20 minutes according to the abovementioned articles by W. J. Scharle).

Conventionally, if the vaporization pump is permanently maintained at cryogenic temperature, the time needed for the backup system to reach 100% of its capacity in a stable manner is around 5 minutes, made up by 1 to 2 minutes for the pump to start up and 2 to 3 minutes for the vaporization exchanger to come up to speed. A judicious choice of the various components (short pipes between the pump and the storage tank and between the pump and the exchanger) makes it possible to reduce this time to 3 minutes. In certain cases, this time of 3 minutes is still too long as regards constraints on permitted pressure fluctuation in the line—in this case, as described above, one solution consists in installing, downstream of the exchanger, gas buffer tanks pressurized for example at 200 bar and dimensioned to supply the production for 1 to 3 minutes, the time that the system made up of the pump and the vaporizer requires to reach its normal operating speed. The drawback of this solution is its high price for installing a high-pressure tank, an oxygen expansion station and an oxygen compression system. The latter is provided by a piston compressor or more generally by another backup vaporization unit with very high-pressure piston pumps and large-volume/high-pressure atmospheric vaporization hairpin, pump for filling the buffer tanks, etc.

The start-up of a backup vaporization unit requires a certain amount of time. To start up the cryogenic pumps (which are kept cold) requires about 1 minute, and likewise the vaporization hairpin cannot come into steady-state operation instantaneously.

During the time to bring the backup vaporization unit into service, the pressure in the customer's network will drop, following a curve whose slope depends on the volume of water in the network and on the flow consumed. Therefore the low pressure limit (−1%) may be rapidly reached (in less than 5 seconds) if the length of the customer's network is less than one kilometer.

It is therefore necessary to have an oxygen supply system that provides the necessary flow to the customer during start-up of the pumps.

One subject of the invention is a method of supplying a pressurized gas, in which:

a) a pressurized gas is produced at a high production pressure as final product by separating a gas mixture in a separation unit;

b) a liquid to be pressurized is stored in a storage tank;

c) liquid is withdrawn from the storage tank and pressurized by a pump, and at least part of the pressurized liquid is vaporized in a vaporizer in order to produce the pressurized backup gas having substantially the same purity or a higher purity than the pressurized gas to be produced; and d) liquid is made to flow in an approximately vertical pipe, possibly inside the cold box of a cryogenic distillation unit, and at least one portion of the length of the pipe lies at a level above the vaporizer, characterized in that, before and/or during start-up of the pump, liquid is sent from the pipe to the vaporizer where it vaporizes in order to supply the pressurized backup gas having substantially the same purity or a higher purity than the pressurized gas to be produced.

According to other, optional features:

- the height of the pipe is such that the hydrostatic pressure is sufficient to overcome the head losses associated with the vaporization;
- the liquid flows in the pipe under a pressure greater than the pressure at which the backup gas is used and the liquid is pressurized upstream of the vaporizer by the hydrostatic pressure and optionally by a pump;

the liquid flows in the pipe under a pressure equal to or below the pressure at which the backup gas is used;

the pipe is fed at least partly from the storage tank, and the pipe is fed at least partly from a column of the cryogenic separation unit inside the cold box, the separation unit supplying, in normal operation, product gas having the same characteristics as the backup gas via a main line by vaporization of a liquid withdrawn from the air separation unit, one stream of the liquid is sent to one end of the pipe and another stream of the liquid is withdrawn from the other end of the pipe and sent back into the air separation unit.

According to a preferred mode of operation:

i) in normal operation, the separation unit supplies product gas;

ii) in the event of a breakdown or reduced operation of the separation unit, the backup gas is supplied by vaporization of the liquid in the vaporizer;

vi) in normal operation, the stream of liquid flows permanently in the pipe;

vii) before and/or during start-up of the pump, a stream of liquid flows under gravity from the lower end of the pipe into the vaporizer; and viii) before and/or during start-up of the pump, a stream of gas pressurized to a pressure equal to or higher than the pressure of the pressurized gas to be produced is sent to the upper end of the pipe.

According to other, optional aspects:

the liquid withdrawn from the unit is pressurized, one portion of the pressurized liquid is sent into the exchange line of the unit, in order to constitute the product gas, and another portion of the pressurized liquid is sent into the vertical pipe; and the line is fed at least partly from a cryogenic storage tank (the storage tank), a stream of liquid is sent to one end of the line and another stream of the liquid is withdrawn from the other end of the line, pumped and sent back to the storage tank.

Another subject of the invention is an installation for supplying a pressurized, comprising:

i) a separation unit for separating a gas mixture;

ii) a pressurized gas supply line connected to the separation unit;

iii) a liquid storage tank;

iv) a vaporizer;

v) an approximately vertical pipe;

vi) means connecting the storage tank to the vaporizer;

vii) means connecting the pipe to the vaporizer; and viii) means for withdrawing the vaporized liquid from the vaporizer in order to form a pressurized backup gas, characterized in that it includes pressurizing means, downstream of the storage tank and upstream of the vaporizer, and auxiliary means for pressurizing the liquid in the pipe, which means are upstream of the vaporizer.

According to other aspects of the invention:

the auxiliary means are formed by a pressurized-gas feed line connected to the upper end of the pipe and the height of the pipe and optionally a pump;

the pipe is located inside the cold box of a cryogenic distillation unit or is integrated into the storage tank;

the pipe is located inside the cold box of a cryogenic distillation unit, comprising a cryogenic distillation unit in which the vertical pipe is a line of the cryogenic distillation unit and including means for connecting the upper and lower ends of the pipe to a column of the distillation unit;

includes means for supplying a first portion of the liquid coming from a column of the unit to an exchange line, where it vaporizes to form a product gas in a main line, and a second portion of the liquid to the line;

the means for supplying a first portion of the liquid coming from a column of the unit to an exchange line, where it vaporizes to form a product gas in a main line, and a second portion of the liquid for the line are formed by a pump; and the upper end of the vertical pipe is connected to the pressurized-gas supply line via a (the) pressurized-gas feed line.

The invention will be described in greater detail with reference to FIGS. 1 to 6, which are diagrams showing the principle of a cryogenic separation unit and of a backup gas supply unit operating according to the method of the invention.

FIG. 1 shows an air separation unit comprising a double column with a medium-pressure column 3 thermally coupled to a low-pressure column via a condenser 4. The unit is fed with compressed, purified and cooled air, the cooling taking place in the exchange line (not illustrated). There is also a source of refrigeration needed for the distillation, which may include at least one Claude turbine, a blowing turbine or a nitrogen turbine. The usual lines for taking rich liquid and lean liquid from the medium-pressure column to the low-pressure column have not been illustrated for the sake of simplification. Waste nitrogen (not illustrated) is withdrawn from the top of the low-pressure column and is warmed in the exchange line 7. The exchange line 7, the bubble column 3, 5, the turbine(s), the rich-liquid and lean-liquid take-up lines and an approximately vertical pipe 13 are contained within an insulated cold box 33.

The air separation unit is designed to supply a stream 31 of pressurized gaseous oxygen. Now, if this stream is interrupted, in the event of the unit breaking down, or is insufficient, it is necessary to produce a backup gas 29 by vaporizing liquid oxygen stored in a storage tank 9. The liquid oxygen is stored at low pressure, being pressurized by an emergency pump 11 and vaporized against a flow of steam in a vaporizer 27.

The air separation unit produces a liquid oxygen stream 15, which is pressurized by a pump 12 to a pressure P1 and divided into two. A first stream 17 passes through an open valve V5, vaporizes in the exchange line 7 and passes through the open valve V6. This stream constitutes the production 31 of the air separation unit sent to the customer. The valve V5 serves to throttle the delivery of the pump 12, the head loss in the valve V5 being slightly greater than the hydraulic height of a vertical pipe 13 to which the second liquid stream 19 feeds via the valve V1.

The vertical pipe 13 installed in the cold box extends over the entire height H of the cold box 33 so as to be substantially above a vaporizer 27. The diameter of the vertical pipe 13 is defined so as to store a sufficient volume of high-pressure cryogenic fluid that corresponds to 1 minute's supply of high-pressure oxygen gas to the customer. It is very easy to find large-diameter cryogenic pipes resistant to very high pressures. Of course, the moment that the pipe contains the required amount of liquid, in order to provide the backup gas supply during start-up of the pump 11, the pipe may be shorter or slightly longer than the height of the highest component of the cold box (for example, the top of the low-pressure column or argon column).

In normal operation, this pipe is coursed by a small stream of high-pressure liquid at pressure P1 coming from pump 12 of the pump unit (via the valve V1). The liquid is then expanded (through the valve V2) and sent into the bottom of the low-pressure column via the upline 23 so that the liquid is continuously in circulation. This circulation is needed in order to ensure that the pipe 13 is fully filled with fresh cryogenic liquid.

The pressure $P_m$ of the gas in the main 17, 31 is below the pressure P1 at the upper end of the vertical pipe 13, the difference being essentially equal to the head loss in the exchange line 7. Obviously, the pressure P2 at the lower end of the vertical pipe is higher than the pressure P1 and equal to P1+ρgH, if the pipe extends over the entire height of the cold box.

In the case of FIG. 1, the circulation takes place from the top of the vertical pipe 13 downward, but it could be from the bottom of this pipe upward.

Figure 2:
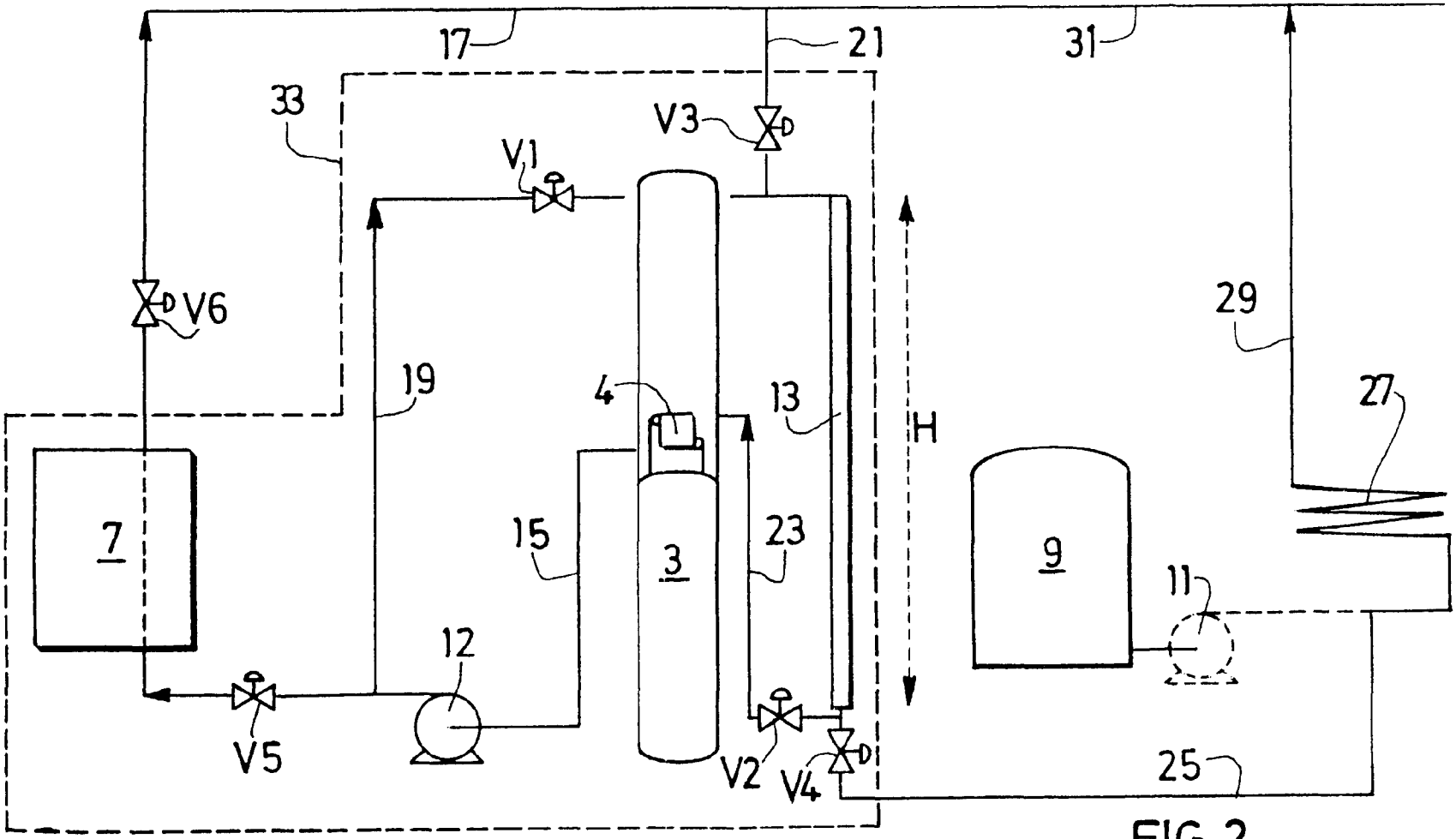

When the air separation unit is shut down, as seen in FIG. 2, the valves V1 and V2 are closed and the pressure at the upper end of the vertical pipe 13 is equalized with the pressure of the main 17, 31 by the opening of a valve V3 installed on a line 21 that connects the upper end of the vertical pipe 13 to the lines 17, 31 of the customer's main. The liquid contained in the pipe 13 is finally sent, by flowing under gravity, into the vaporizer 27 by opening the flow control valve V4 installed on the line 25 that connects the lower end of the vertical pipe to the inlet of the vaporizer 27.

Figure 3:
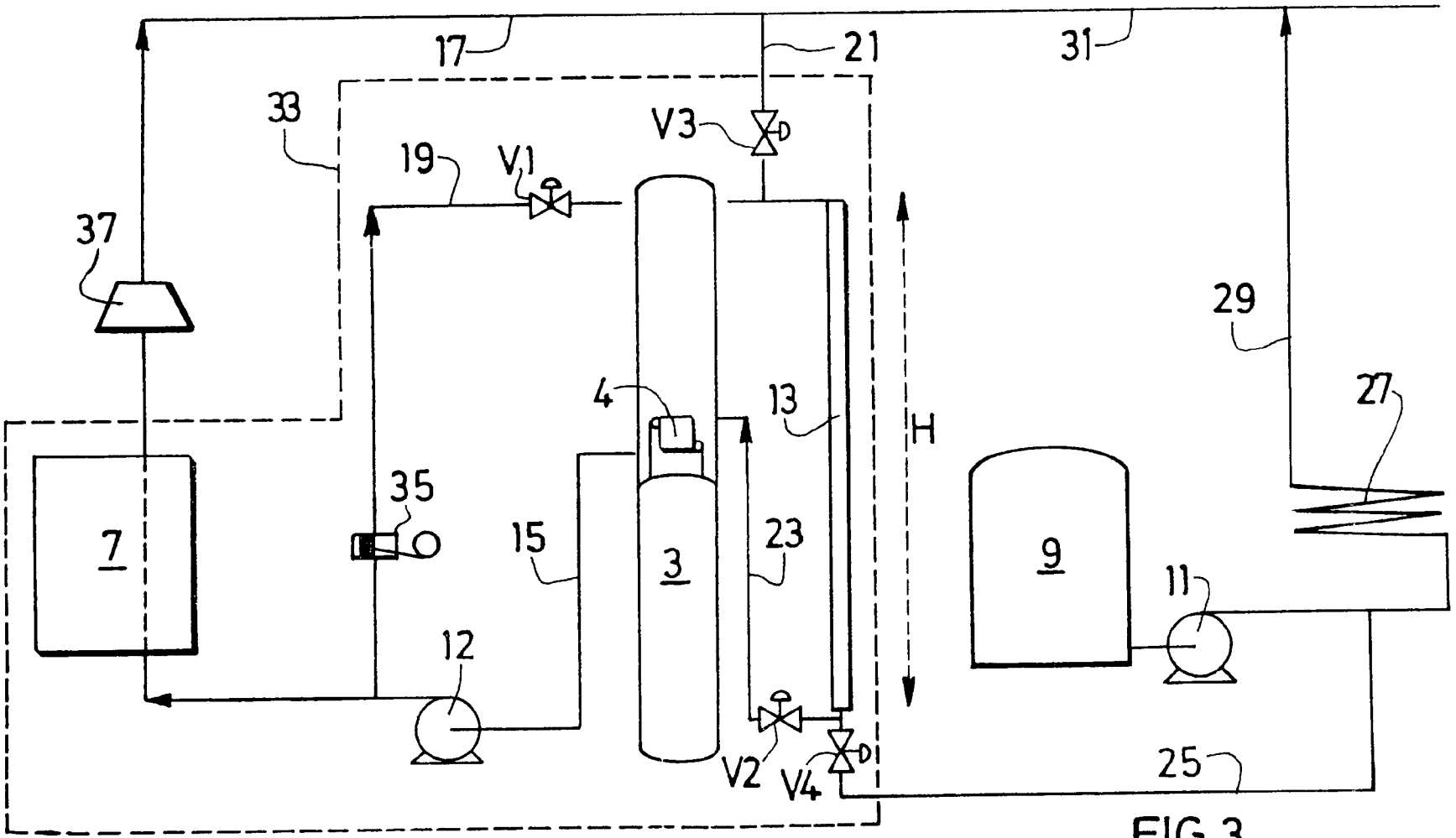

FIG. 3 shows the case in which the air separation unit includes an oxygen compressor 37 for supplying the customer with high-pressure oxygen—the diagram remains the same, but the circulation of liquid in the pipe 13 and the lines 19, 23 is provided by a piston pump 35.

Figure 4:
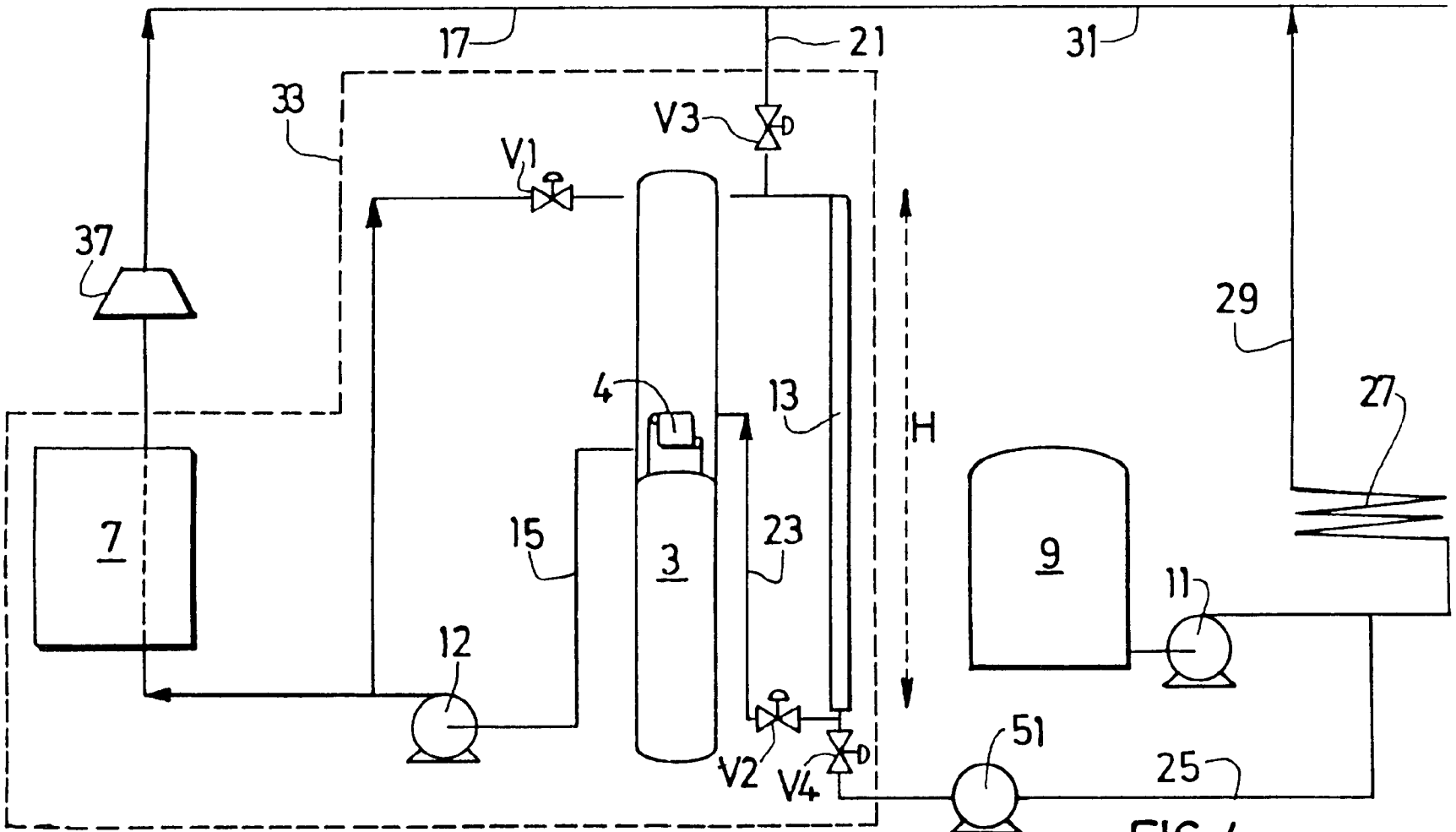

However, the pump is not essential since, as may be seen in FIG. 4, the vertical pipe 13 can operate at a pressure below the pressure of the high-pressure oxygen sent to the customer. In this case, it may be useful to add a pump 51 between the outlet of the vertical pipe 13 and the inlet of the vaporizer 27. Otherwise, the liquid may be pressurized only by the delivery of gas via the valve V3.

Figure 5:
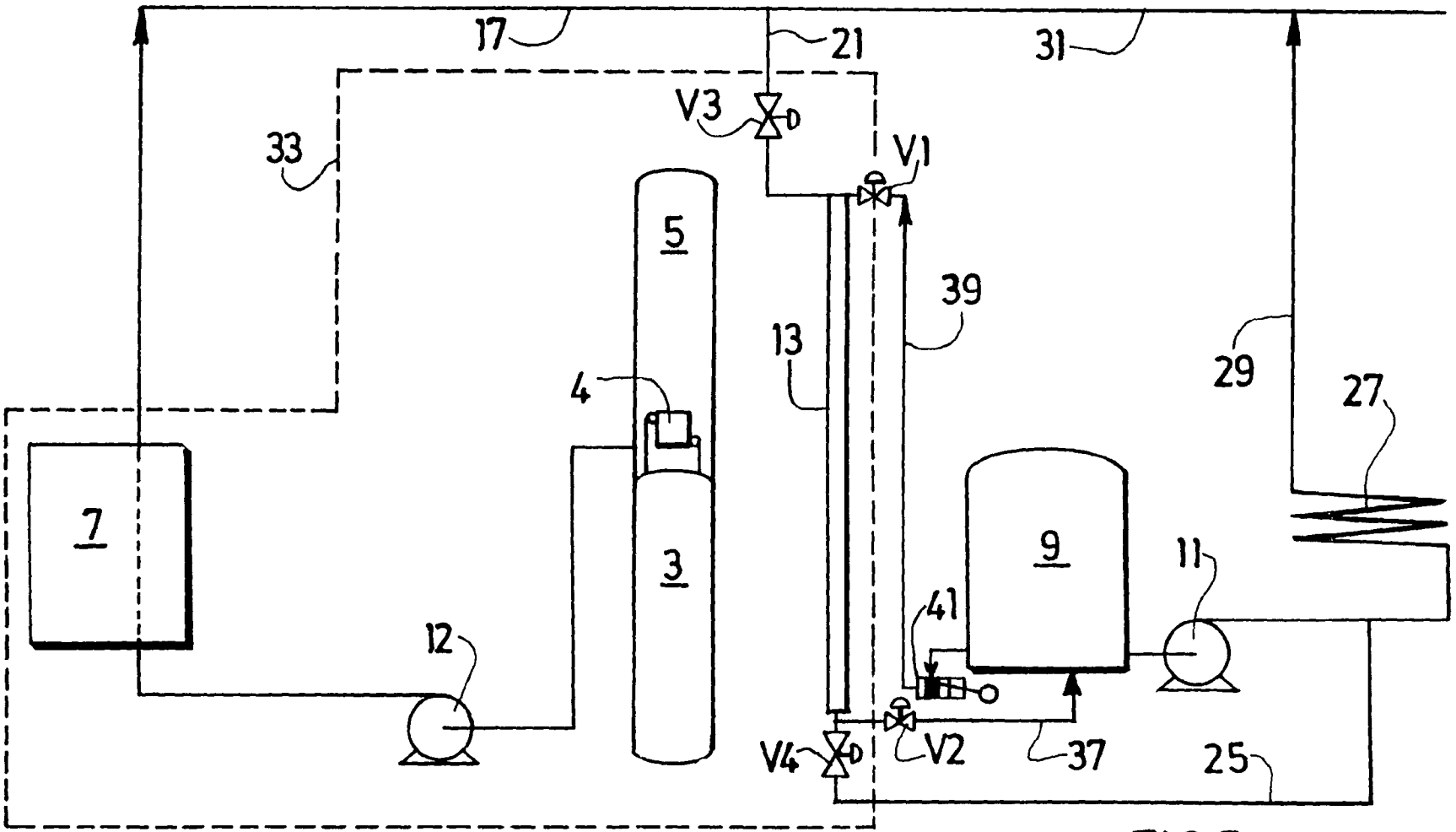

FIG. 5 shows that the vertical pipe, while still being contained within the cold box of an air separation unit, is not necessarily fed from the latter. In the example, under normal operation of the installation, with the pump 12 operating and the pump 11 shut down, liquid oxygen circulates between the storage tank 9 and the vertical pipe 13 via a piston pump 41, which feeds the upper end of the pipe 13, and a valve V2, which returns the liquid to the storage tank 9 via the line 37.

In the event of the air separation unit shutting down, the valves V3 and V4 are opened, the valves V1 and V2 are closed and the fresh liquid contained in the pipe 13 flows via the line 25 to the vaporizer 27 in order to provide the backup gas production with the pump 11 in operation.

Figure 6:
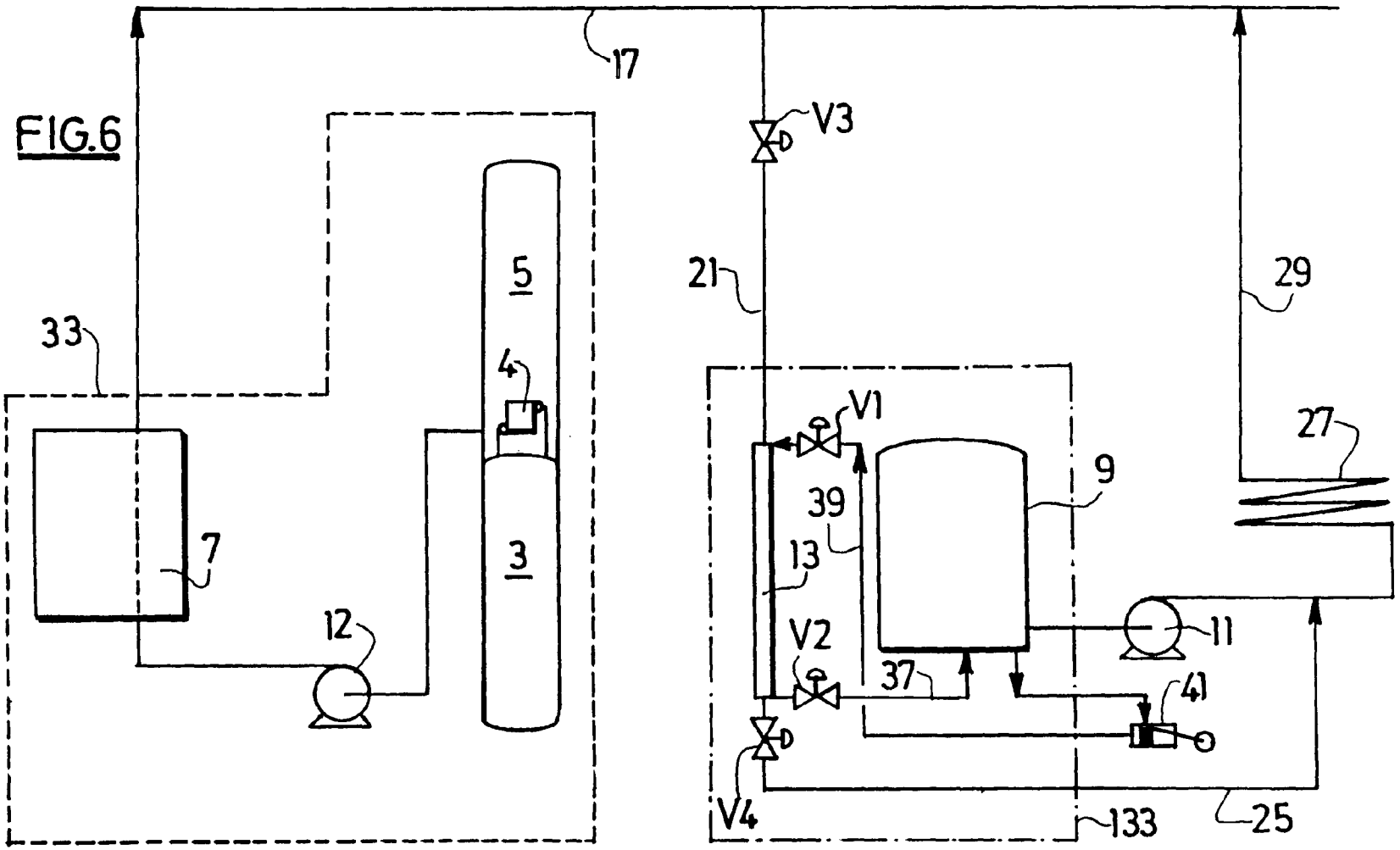

FIG. 6 shows the case in which the vertical pipe is not integrated into the air separation unit but into the storage tank 9 outside the cold box. The pipe placed in the inter-wall space is effectively insulated and may be very tall, the storage tank sometimes being 30 meters in height. The top of the pipe receives liquid from the inside of the storage tank via the valve V1 and the pipe fills up, forming a liquid column. Before or during start-up of the pump 11, the valve V4 is opened and the liquid is taken into the vaporizer 27, optionally after a pumping step. In this case, the upline is completely isolated from the cold box 33. This embodiment is useful if the cold box is shorter than the storage tank or when the separation unit does not have a cold box.

The invention has been described in relation to a double air separation column, but it is easy to see that it applies to a single column containing many theoretical trays, a triple column, or a column system that includes an argon column.

The separation unit may separate air by cryogenic distillation, by permeation, by adsorption or any other known means.

The invention claimed is:

1. A method of supplying a pressurized gas, comprising:

a) separating a gas mixture in a separation unit (3, 5) and producing a first pressurized gas;

b) storing a liquid to be pressurized in a storage tank (9);

c) withdrawing at least a portion of the liquid from the storage tank and pressurizing the withdrawn liquid with a pump (11);

d) vaporizing at least part of the pressurized liquid in a vaporizer (27) and producing a second pressurized gas (29) having substantially the same composition and purity or a higher purity than the first pressurized gas;

e) flowing liquid in an approximately vertical pipe (13) relative to the separation unit, at least one portion of the length of the pipe lies at a level above the vaporizer;

f) sending liquid from the approximately vertical pipe to the vaporizer without passing through the pump (11) or the storage tank, before and/or during start-up of the pump (11), said approximately vertical pipe being directly connected to the inlet of the vaporizer; and g) vaporizing the liquid to a third gas and supplying the third gas, the third gas having substantially the same composition and purity or a higher purity than the first pressurized gas (31).

2. The method of claim 1, wherein the height (H) of the pipe is such that hydrostatic pressure in the pipe is sufficient to overcome head losses associated with the vaporization.

3. The method of claim 1, wherein the liquid flows in the pipe (13) under a pressure greater than the pressure at which the second pressurized gas (29) is used, and the liquid is pressurized upstream of the vaporizer by hydrostatic pressure.

4. The method of claim 1, wherein the liquid flows in the pipe under a pressure equal to or below the pressure at which the second pressurized gas is used.

5. The method of claim 1, wherein the pipe (13) is fed at least partly from the storage tank (9).

6. The method of claim 1, wherein the pipe (13) is fed at least partly from a column (5) of the separation unit inside a cold box (33), the separation unit supplying the first pressurized gas (31) having the same characteristics as the second pressurized gas (29) via a main line by vaporization of a liquid withdrawn from the separation unit, wherein one stream of the liquid is sent to one end of the pipe and another stream (23) of the liquid is withdrawn from the other end of the pipe and sent back into the separation unit.

7. The method of claim 6, wherein:

the one stream of liquid flows permanently in the pipe (13);

before and/or during start-up of the pump, a stream of liquid flows under gravity from the lower end of the pipe (13) into the vaporizer; and before and/or during start-up of the pump, a stream of the third gas (21)

having a pressure equal to or higher than the pressure of the first pressurized gas is sent to the upper end of the pipe.

8. The method of claim 6, wherein the liquid withdrawn from the unit is pressurized, one portion of the pressurized liquid is sent into the exchange line (7) of the unit and another portion of the pressurized liquid is sent into the vertical pipe (13).

9. The method of claim 1, wherein the pipe is fed at least partly from the storage tank (9), a stream of liquid (39) is sent to one end of the pipe and another stream (37) of the liquid is withdrawn from the other end of the pipe, pumped and sent back to the storage tank.

10. The method of claim 1, wherein flowing liquid in the approximately vertical pipe comprises flowing the liquid inside a cold box (33).

11. The method of claim 3, wherein the liquid is additionally pressurized by a pump (51) located between an end of the pipe and the vaporizer.

* * * * *